US009278772B2

(12) United States Patent
Vaughn et al.

(10) Patent No.: US 9,278,772 B2
(45) Date of Patent: Mar. 8, 2016

(54) COMBINATION WIRE AND PLASTIC STRAPPING DEVICE

(71) Applicant: L & P PROPERTY MANAGEMENT COMPANY, South Gate, CA (US)

(72) Inventors: Mark A. Vaughn, Wyandotte, OK (US); Timothy Charles Stamps, Carl Junction, MO (US); James R. York, Carthage, MO (US)

(73) Assignee: L&P Property Management Company, South Gate, CA (US)

( * ) Notice: Subject to any disclaimer, the term of this patent is extended or adjusted under 35 U.S.C. 154(b) by 116 days.

(21) Appl. No.: 14/185,524

(22) Filed: Feb. 20, 2014

(65) Prior Publication Data

US 2015/0232213 A1 Aug. 20, 2015

(51) Int. Cl.

| | |
|---|---|
| ***B65B 13/02*** | (2006.01) |
| ***B65B 13/04*** | (2006.01) |
| ***B65B 13/14*** | (2006.01) |
| ***B65B 13/24*** | (2006.01) |

(52) U.S. Cl.

CPC ..... *B65B 13/14* (2013.01); *B65B 13/022* (2013.01); *B65B 13/04* (2013.01); *B65B 13/24* (2013.01)

(58) Field of Classification Search

CPC ..... B65B 13/04; B65B 13/14; B65B 13/24; B65B 13/26; B65B 13/28; B65B 13/022; B65B 27/12

USPC ..... 100/2, 3, 8, 26, 29, 31, 32, 33 R, 33 PB; 53/399, 589

See application file for complete search history.

(56) References Cited

U.S. PATENT DOCUMENTS

| | | | |
|---|---|---|---|
| 25,783 | A | 10/1859 | White |
| 1,460,649 | A | 7/1923 | Gerrard |

(Continued)

FOREIGN PATENT DOCUMENTS

| | | | |
|---|---|---|---|
| CN | 2050497 | U | 1/1990 |
| CN | 2451488 | Y | 10/2001 |

(Continued)

OTHER PUBLICATIONS

Brian Taylor, "Fit to be tied: the right wire-tying system conserves costs while keeping bales in ship-shape," Baler Focus, Recycling Today, Feb. 2003. (5 pages).

(Continued)

*Primary Examiner* — Jimmy T Nguyen

(74) *Attorney, Agent, or Firm* — Shook, Hardy & Bacon, L.L.P.

(57) ABSTRACT

A system and method of using a combination strapping machine including a wire tying system and a plastic tying system is provided. Embodiments of the strapping machine include a common frame coupled to a wire strapping system, a single wire track, a plastic strapping system, and a single plastic track. In some embodiments, the combination strapping machine includes a strapping machine frame having a common track perimeter and a top side. Further, the strapping machine includes a plastic tying system configured to apply a plastic strap to a baled material, and a wire tying system configured to apply a wire strap to the baled material, wherein the track for the wire tying medium is adjacent the track for the plastic tying medium. In some embodiments, the combination strapping machine is controlled by a common interface that coordinates both plastic and wire strapping.

15 Claims, 7 Drawing Sheets

(56) References Cited

U.S. PATENT DOCUMENTS

| | | | |
|---|---|---|---|
| 1,868,141 | A | 7/1932 | Harvey |
| 1,939,746 | A | 12/1933 | Whitman |
| 2,756,783 | A | 7/1956 | Osuch |
| 2,853,885 | A | 9/1958 | Seltzer |
| 2,859,687 | A | 11/1958 | Hill |
| 2,907,356 | A | 10/1959 | Miille |
| 2,922,359 | A | 1/1960 | Brouse et al. |
| 2,963,958 | A | 12/1960 | Nelson |
| 3,037,534 | A | 6/1962 | Brouse |
| 3,037,535 | A | 6/1962 | Linehan |
| 3,086,450 | A | 4/1963 | Tarbox |
| 3,099,204 | A | 7/1963 | Stromberg |
| 3,232,216 | A | 2/1966 | Enstad et al. |
| 3,251,296 | A | 5/1966 | Smith |
| 3,295,436 | A | 1/1967 | Dalton et al. |
| 3,327,618 | A | 6/1967 | Cook |
| 3,338,273 | A | 8/1967 | Kalning |
| 3,447,448 | A | 6/1969 | Pasic |
| 3,880,204 | A | 4/1975 | Sarff et al. |
| 3,888,134 | A | 6/1975 | Miranda |
| 3,889,584 | A | 6/1975 | Wilund-Bergeforsen et al. |
| 4,079,667 | A | 3/1978 | Lems |
| 4,114,527 | A | 9/1978 | O'Neill |
| 4,164,176 | A | 8/1979 | Brouse et al. |
| 4,177,842 | A | 12/1979 | Dilley |
| 4,252,157 | A | 2/1981 | Ohnishi |
| 4,302,991 | A | 12/1981 | Brouse et al. |
| 4,403,542 | A | 9/1983 | Lewis |
| 4,566,378 | A | 1/1986 | Fleissner |
| 4,577,554 | A | 3/1986 | Brouse |
| 4,587,791 | A | 5/1986 | Brouse et al. |
| 4,611,534 | A | 9/1986 | Kudlicka |
| 4,655,264 | A | 4/1987 | Dilley |
| 4,730,434 | A | 3/1988 | Knudsen |
| 4,739,700 | A | 4/1988 | Brouse |
| 4,817,519 | A | 4/1989 | Brouse et al. |
| 4,827,991 | A | 5/1989 | Jacobsen et al. |
| 5,078,057 | A | 1/1992 | Pearson |
| 5,392,821 | A | 2/1995 | Chudy |
| 5,433,255 | A | 7/1995 | Wiedel |
| 5,467,804 | A | 11/1995 | Kupferschmidt |
| 5,494,081 | A | 2/1996 | Wiedel |
| 5,577,760 | A | 11/1996 | Pressler |
| 5,704,283 | A | 1/1998 | Wiedel |
| 5,870,950 | A | 2/1999 | Wiedel |
| 5,921,289 | A | 7/1999 | Johnson |
| 6,009,646 | A | 1/2000 | Johnson |
| 6,032,575 | A | 3/2000 | Johnson |
| 6,283,017 | B1 | 9/2001 | Johnson |
| 6,363,843 | B1 | 4/2002 | Daniel et al. |
| 6,571,691 | B1 | 6/2003 | Jones |
| 6,640,700 | B2 | 11/2003 | Helland et al. |
| 6,745,677 | B2 | 6/2004 | Pearson et al. |
| 6,755,123 | B2 | 6/2004 | Flaum et al. |
| 6,857,252 | B2 | 2/2005 | Haberstroh |
| 6,920,741 | B2 | 7/2005 | Devine |
| 6,923,113 | B2 | 8/2005 | Bobren |
| 6,957,835 | B2 | 10/2005 | Rotole |
| 6,962,109 | B2 | 11/2005 | Bobren et al. |
| 6,968,779 | B2 | 11/2005 | Doyle et al. |
| 6,975,911 | B2 | 12/2005 | Stamps et al. |
| 7,085,625 | B2 | 8/2006 | Timothy et al. |
| 7,124,679 | B2 | 10/2006 | Daniel et al. |
| 7,146,294 | B1 | 12/2006 | Waitkus |
| 7,373,877 | B2 | 5/2008 | Wiedel |
| 7,380,574 | B2 | 6/2008 | Wiedel |
| 8,397,632 | B2 | 3/2013 | Millet et al. |
| 8,757,055 | B2 | 6/2014 | Millett et al. |
| 2003/0024404 | A1 | 2/2003 | Daniel et al. |
| 2004/0144264 | A1 | 7/2004 | Daniel et al. |
| 2006/0042477 | A1 * | 3/2006 | Daniel ..... B65B 27/12 100/26 |
| 2006/0042478 | A1 * | 3/2006 | Daniel ..... B65B 27/12 100/26 |
| 2009/0250930 | A1 | 10/2009 | Eylenbosch et al. |
| 2013/0019764 | A1 | 1/2013 | Yang |
| 2013/0180416 | A1 | 7/2013 | Stein et al. |
| 2013/0247515 | A1 | 9/2013 | Actis |

FOREIGN PATENT DOCUMENTS

| | | | |
|---|---|---|---|
| CN | 2527767 | Y | 12/2002 |
| GB | 325783 | A | 5/1930 |
| GB | 417803 | A | 10/1934 |
| GB | 420098 | A | 11/1934 |
| GB | 474813 | A | 11/1937 |
| GB | 704931 | A | 3/1954 |
| GB | 984251 | A | 2/1965 |

OTHER PUBLICATIONS

"Bundling Demand Met by ISB," Converter the International Technical Publication for the Paper, Board, Film and Foil Converter, Jul. 2003, vol. 40, Issue 7, p. 20. (2 pages).

Cranston Machinery Co., Inc., Oak Grove, Oregon, 1000 Series Wire Strapper, 25 pages (Excerpts from Manual). Sep. 1996.

International Search Report with Written Opinion dated May 22, 2015 in Application No. PCT/US2015/015382, 11 pages.

"Samuel Strappiing Systems. The Science of Strap Selection. Handbook [online]. Oct. 2, 2012 [retrieved on May 20, 2015]. Retrieved from the Internet:<URLhttp://www. thomasnet.com/white-papers/abstract/1 01792/the-science-of-strap-selection. html>".

International Search Report with Written Opinion dated Jun. 4, 2015 in Application No. PCT/US2015/019446, 11 pages.

Chinese Office Action dated Feb. 28, 2015 in Application No. 201280052589.9, 16 pages.

European Search Report dated Apr. 3, 2015 in Application No. 12827753.0, 5 pages.

International Search Report with Written Opinion dated May 12, 2011 in Application No. PCT/US2011/026856, 7 pages.

Non-Final Office Action dated Aug. 2, 2011 in U.S. Appl. No. 12/717,616, 11 pages.

Final Office Action dated Dec. 28, 2011 in U.S. Appl. No. 12/717,616, 9 pages.

Non-Final Office Action dated Jun. 12, 2012 in U.S. Appl. No. 12/717,616, Mail Date: Jun. 12, 2012, 6 pages.

International Search Report with Written Opinion dated Nov. 20, 2012 in Application No. PCT/US2012/052869, 6 pages.

Notice of Allowance dated Nov. 23, 2012 in U.S. Appl. No. 12/717,616, 9 pages.

Non-Final Office Action dated Aug. 1, 2013 in U.S. Appl. No. 13/220,798, 16 pages.

Non-Final Office Action dated Aug. 27, 2013 in U.S. Appl. No. 13/753,188, 8 pages.

Final Office Action dated Feb. 4, 2014 in U.S. Appl. No. 13/220,798, 16 pages.

Notice of Allowance dated Feb. 11, 2014 in U.S. Appl. No. 13/753,188, 8 pages.

Non-Final Office Action dated Jun. 20, 2014 in U.S. Appl. No. 13/220,798, 15 pages.

Non-Final Office Action dated Feb. 13, 2015 in U.S. Appl. No. 14/263,483, 8 pages.

International Search Report with Written Opinion dated Jan. 27, 2015 in Application No. PCT/US2014/053986, 11 pages.

Notice of Allowance dated Feb. 2, 2015 in U.S. Appl. No. 13/220,798, 8 pages.

Notice of Allowance dated Mar. 11, 2015 in U.S. Appl. No. 14/263,483, 8 pages.

Non-Final Office Action Dated Sep. 11, 2015 in U.S. Appl. No. 14/202,407, 10 pages.

* cited by examiner

COMBINATION WIRE AND PLASTIC STRAPPING DEVICE

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

Embodiments of the present invention relate to a combination strapping machine including a wire tying system and a plastic tying system. More particularly, embodiments of the present invention relate to a combination strapping machine for baling recycled materials, having a common frame coupled to both a wire strapping system for applying a wire tying medium, and a plastic strapping system for applying a plastic tying medium.

BACKGROUND OF THE INVENTION

Traditional bulk-material baling machines incorporate a tying system for wrapping and/or securing the baled material, such as a wire tying system. In forming bales of compressible materials, it is important to surround the baled material with a tying medium having sufficient strength to maintain the form of the compressed bale for shipping and/or storage. At the same time, the tying medium used to secure a bale must be adequately tensioned by the tying system, as well as securely knotted and/or tied around the bale. As the characteristics of each type of tying medium are unique, a single baling machine typically uses a single tying medium with a single tying system coupled to the machine. As such, a baling machine is not able to vary the types of tying media applied to different portions of a single bale.

Accordingly, embodiments of the present invention introduce technology for resolving the above-mentioned issues conventionally experienced when varying the tying medium used for bulk-material baling systems.

In one embodiment of the invention, a combination strapping machine for use on a baler is provided. The strapping machine includes a strapping machine frame having a common track perimeter and a top side; a plastic tying system coupled to the top side of the strapping machine frame, the plastic tying system having a plastic track, wherein the plastic tying system is configured to apply a plastic strap to a baled material; and a wire tying system coupled to the top side of the strapping machine frame, the wire tying system having a wire track, wherein the wire tying system is configured to apply a wire strap to the baled material, wherein the wire track is adjacent the plastic track.

In another illustrative aspect, a combination strapping machine for dynamic strapping of a first tying medium and a second tying medium on a baler includes: a strapping machine frame having a common track perimeter; a first tying system for the first tying medium, the first tying system coupled to a first portion of the strapping machine; and a second tying system for the second tying medium, the second tying system coupled to a second portion of the strapping machine, wherein the first tying system and the second tying system are configured to alternately apply straps to a baled material secured by the combination strapping machine.

According to a third illustrative aspect, embodiments of the invention are directed to a method for strapping a baled material, the method comprising: receiving, by a strapping machine, a material for baling; applying at least one strap of a first tying medium using a first tying assembly coupled to the strapping machine; and applying at least one strap of a second tying medium using a second tying assembly coupled to the strapping machine.

Additional objects, advantages, and novel features of the invention will be set forth in part in the description that follows, and in part will become apparent to those skilled in the art upon examination of the following, or may be learned by practice of the invention.

BRIEF DESCRIPTION OF SEVERAL VIEWS OF THE DRAWINGS

The present invention is described in detail below with reference to the attached drawing figures, wherein.

DETAILED DESCRIPTION OF THE INVENTION

Figure 1:
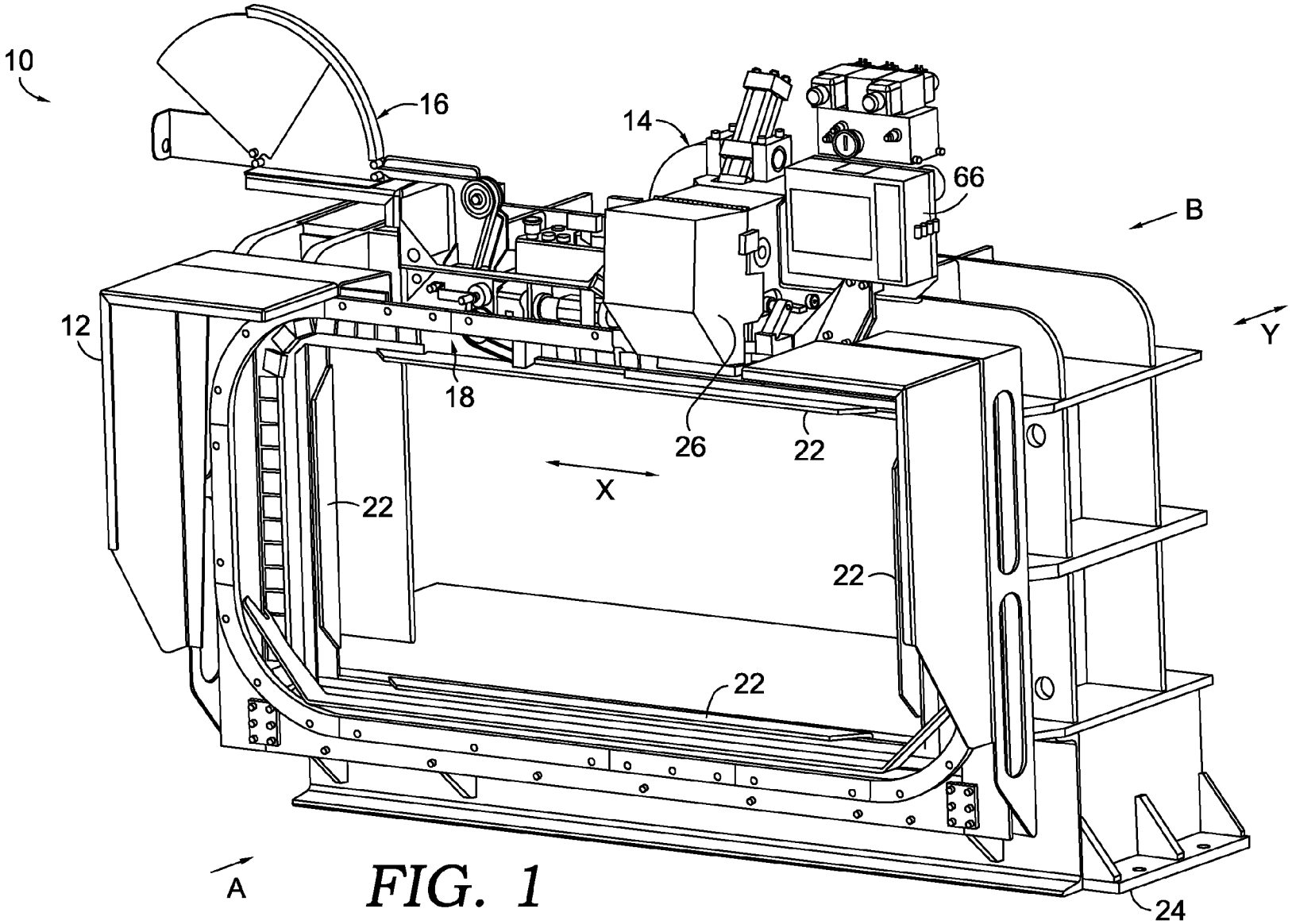
FIG. 1 is a front perspective view of an exemplary strapping machine for bulk-material baling, in accordance with an embodiment of the invention.

The present invention generally relates to a combination strapping machine for applying two different types of tying materials to a single bale, such as a bale of recycled material. In embodiments, the strapping machine is coupled to two separate tying systems and/or strapper heads for dynamically applying and/or attaching plastic straps or wire ties to a baled material. In one embodiment, both the plastic tying system and the wire tying system are adjacent, and coupled to a common strapping machine frame on a top side and/or surface. As such, the tying systems are oriented along an x axis of the width of a strapping machine, offset with respect to the front side and the rear side of the strapping machine along a y axis corresponding to the front-to-rear depth of the machine.

In embodiments, a common controller is configured to coordinate the alternating straps applied by the strapping machine to one or more bales of material. In further embodiments, the common controller may be utilized to alternately apply a plastic strap from the plastic tying system, and a wire tie from a wire tying system. In one embodiment, both the plastic tying medium and the wire tying medium are strapped around the bale using a common track perimeter of the strapping machine frame. As such, the offset welding mechanism (of the plastic tying system) and knotting mechanism (of the wire tying system) are used to apply both traps utilizing a common track perimeter of the strapping machine having a limited amount of space along the top side/surface.

Accordingly, in one embodiment of the invention, a combination strapping machine for use on a baler is provided. The strapping machine includes a strapping machine frame having a common track perimeter and a top side; a plastic tying system coupled to the top side of the strapping machine frame, the plastic tying system having a plastic track, wherein the plastic tying system is configured to apply a plastic strap to a baled material; and a wire tying system coupled to the top side of the strapping machine frame, the wire tying system having a wire track, wherein the wire tying system is configured to apply a wire strap to the baled material, wherein the wire track is adjacent the plastic track.

In some embodiments, the plastic tying system includes a plurality of bloom plates that surround the common track perimeter. In further embodiments, the bloom plates are coupled to the common track perimeter of the strapping machine frame, and are thereby configured to contact a baled material secured within an opening of the strapping machine. In further embodiments, the plastic tying system is configured to apply the plastic strap to the baled material from a first direction relative to the common track perimeter. In one embodiment, the first direction is clockwise. Additionally, embodiments of the wire tying system are configured to apply the wire strap to the baled material from a second direction relative to the common track perimeter, while in some embodiments, the second direction is counterclockwise.

In another illustrative aspect, a combination strapping machine for dynamic strapping of a first tying medium and a second tying medium on a baler includes: a strapping machine frame having a common track perimeter; a first tying system for the first tying medium, the first tying system coupled to a first portion of the strapping machine; and a second tying system for the second tying medium, the second tying system coupled to a second portion of the strapping machine, wherein the first tying system and the second tying system are configured to apply alternating straps to a baled material secured by the combination strapping machine. In embodiments, the first portion of the strapping machine is adjacent the second portion of the strapping machine on a first side of the strapping machine frame. Additionally, in one embodiment, the common track perimeter comprises a first track for the first tying medium and a second track for the second tying medium. In another embodiment, the first tying system is a plastic tying system positioned at a rear side of the combination strapping machine, while in further embodiments, the plastic tying system is configured to apply a plastic strap to the baled material from a first direction relative to the common track perimeter.

In embodiments, the second tying system is a wire tying system positioned at a front side of the combination strapping machine. As such, in some embodiments, the wire tying system is configured to apply a wire strap to the baled material from a second direction relative to the common track perimeter. Embodiments of the combination strapping machine are configured to apply alternating straps to a baled material secured by the combination strapping machine by applying at least one strap of the first tying medium and at least one strap of the second tying medium to the bale. Embodiments of the combination strapping machine further include an integrated controller for controlling the first tying system and the second tying system. In some embodiments, the integrated controller is configured to alternate tying the baled material with multiple straps of the first tying medium and multiple straps of the second tying medium according to a particular order for applying each strap of the first tying material and each strap of the second tying material.

According to a third illustrative aspect, embodiments of the invention are directed to a method for strapping a baled material, the method comprising: receiving, by a strapping machine, a material for baling; applying at least one strap of a first tying medium using a first tying assembly coupled to the strapping machine; and applying at least one strap of a second tying medium using a second tying assembly coupled to the strapping machine. In embodiments, applying at least one strap of a first tying medium comprises applying at least one strap of plastic tying medium. In further embodiments, applying at least one strap of a second tying medium comprises applying at least one strap of wire tying medium. In one embodiment, at least one strap of the first tying medium is applied to the baled material in a clockwise direction relative to a common track perimeter of the strapping machine, and further wherein the at least one strap of the second tying medium is applied to the baled material in a counterclockwise direction relative to a common track perimeter of the strapping machine.

With reference now to FIG. 1, an embodiment of a strapping machine 10 includes a strapping machine frame 12 coupled to a wire tying system 14 and a plastic tying system 16. Both the wire tying system 14 and the plastic tying system 16 may be configured to apply a tying medium to a baled material via the common track perimeter 18. As shown in the embodiment of FIG. 1, based on the application of plastic tying medium to a baled material, the common strapping machine includes bloom plates 22 coupled to the strapping machine frame 12. In some embodiments, the common base 24 supports the strapping machine frame 12 having a wire tying system 14 and a plastic tying system 16 on a top surface.

The exemplary strapping machine 10 also includes a knotter assembly 26 of the wire tying system 14. Embodiments of the invention include a knotter assembly 26 for tying a wire strap around a baled material, such as the knotter assembly described in one or more of the following U.S. patent applications: U.S. application Ser. No. 12/717,616, filed Mar. 4, 2010, entitled "Knotter Assembly," now U.S. Pat. No. 8,397,632 issued Mar. 19, 2013; U.S. application Ser. No. 13/220,798, filed Aug. 30, 2011, entitled "Knotter Assembly," and U.S. application Ser. No. 13/753,188, filed Jan. 29, 2013, entitled "Method For Removing A Twist-Module Sub-Assembly In A Knotter Assembly," the disclosure of each of which is hereby incorporated by reference in its entirety.

Additionally, as shown in FIG. 1, the strapping machine 10 may include a control system 66 coupled directly or indirectly to the strapping machine 10. For example, the strapping machine 10, having both a wire tying system 14 and a plastic tying system 16, may include a common control system 66 configured to control both tying media, such as the control system described in U.S. Application No. 61/873,662, filed Sep. 4, 2013, entitled "Control User Interface For Tying System," the disclosure of which is hereby incorporated by reference in its entirety.

As further depicted in FIG. 1, the strapping machine 10 includes a front side A and a rear side B, oriented with respect to a y axis. In embodiments, the wire tying system 14 is configured towards the front side A of the strapping machine frame 12, while the plastic tying system is configured towards the rear side B of the strapping machine frame 12. Additionally, in some embodiments, wire tying system 14 and plastic tying system 12 are oriented along a common x axis, on a top surface of the strapping machine 10.

Figure 2A:
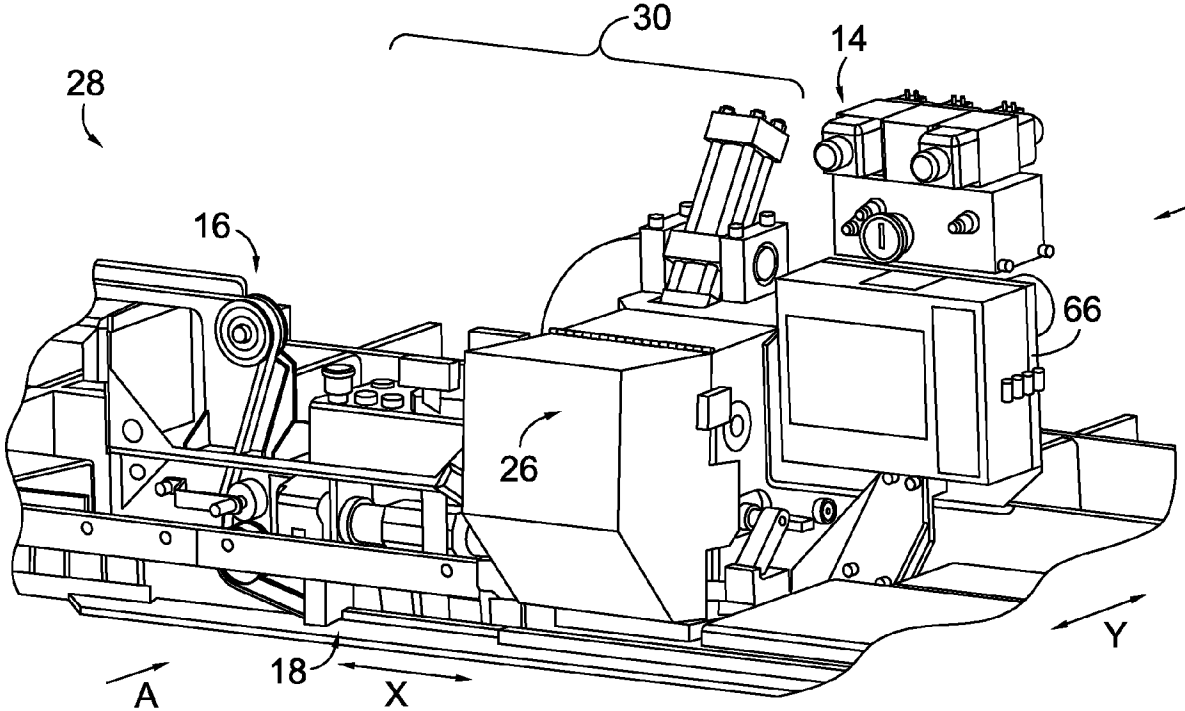
FIG. 2A is an enlarged, front perspective view of the strapping machine of FIG. 1, in accordance with an embodiment of the invention.
Figure 2B:
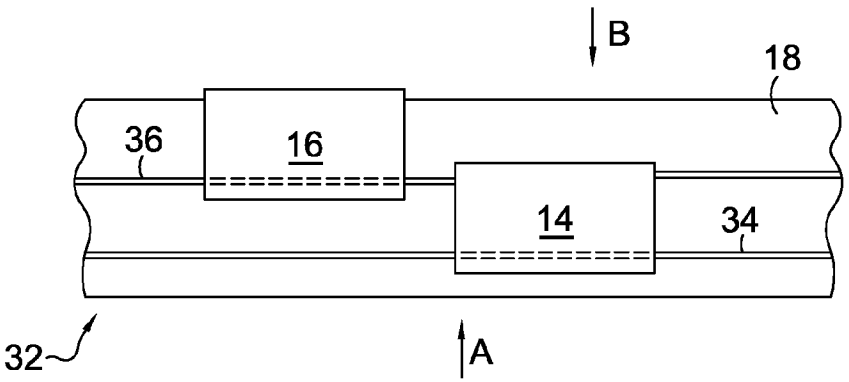
FIG. 2B is a top, schematic diagram of the components of an exemplary strapping machine, in accordance with an embodiment of the invention.

As further shown in the enlarged, perspective view 28 of FIG. 2A, the tying portion 30 of the top of the strapping machine 10 includes at least a portion of the wire tying system 14 and at least a portion of the plastic tying system 16. In embodiments, a portion of each of the wire tying system 14 and the plastic tying system 16 is offset with respect to the common track perimeter 18, enabling a wire track to be positioned adjacent a plastic track along a common track perimeter 18. Accordingly, as shown in the top, schematic diagram 32 of FIG. 2B, the common track perimeter 18 is configured to secure both a wire strap 34 (from a wire tying system 14) and a plastic strap 36 (from a plastic tying system 16).

Figure 3A:
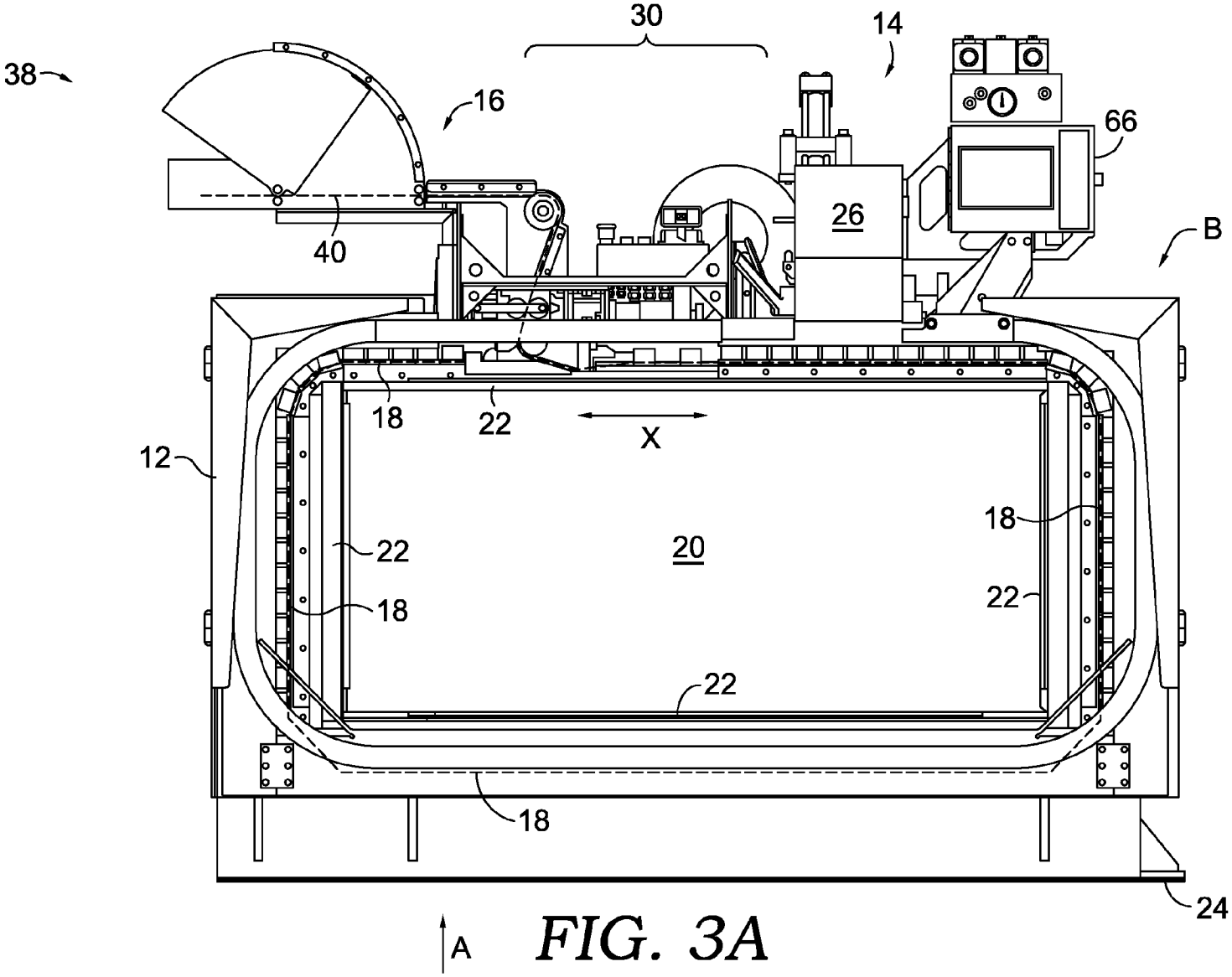
FIG. 3A is a front view of an exemplary strapping machine applying a plastic strap using a plastic tying system, in accordance with an embodiment of the invention.
Figure 3B:
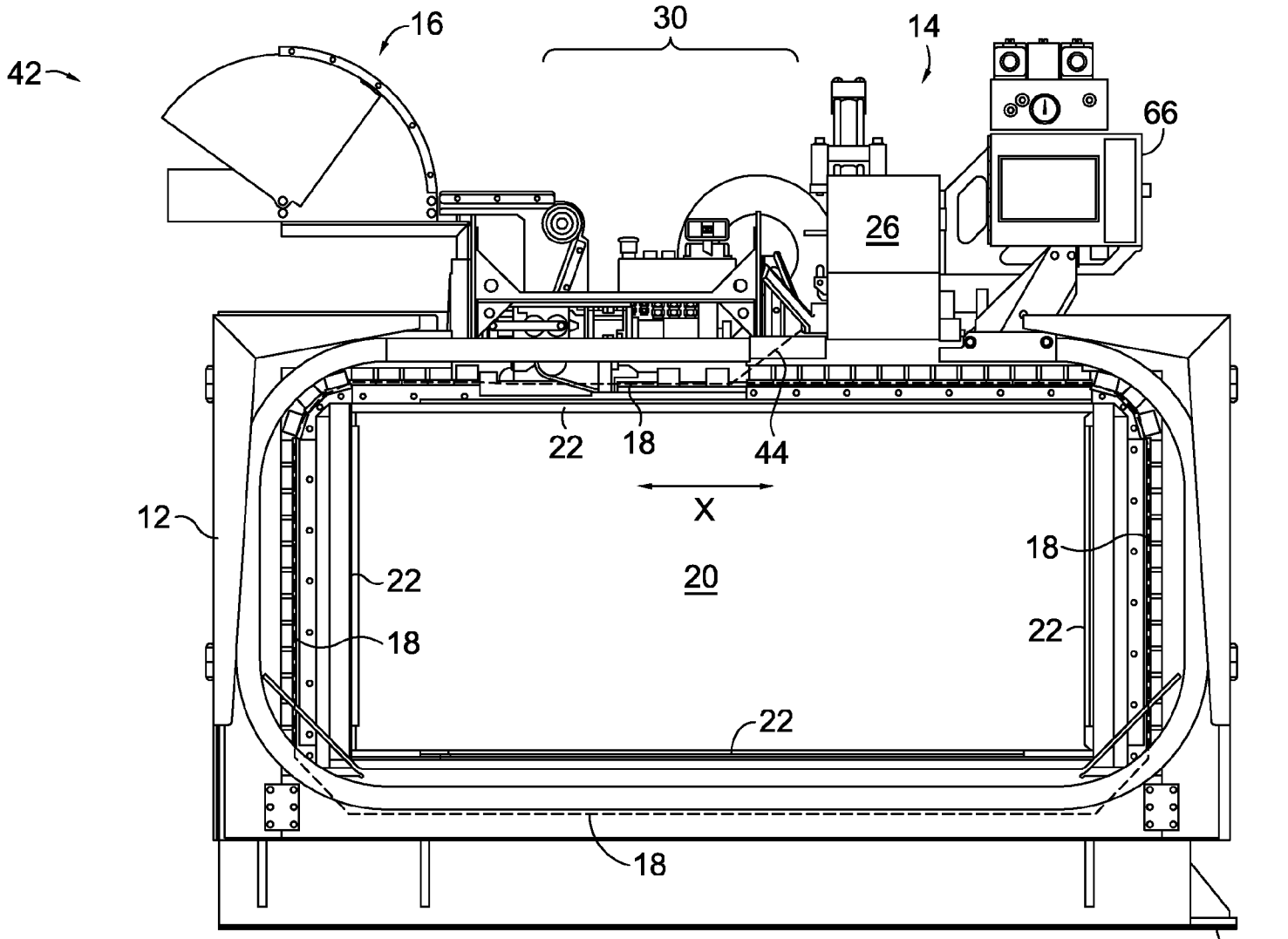
FIG. 3B is a front view of an exemplary strapping machine applying a wire strap using a wire tying system, in accordance with an embodiment of the invention.

Referring next to FIG. 3A, a front view of an exemplary strapping machine 38 depicts the application of a plastic strap 40 around a material based through opening 20, according to one embodiment of the invention. In a further embodiment, the plastic strap 40 is applied using the plastic tying system 16 by travelling along the common track perimeter 18 in a clockwise direction. As shown in FIG. 3B, a front view of an exemplary strapping machine 42 depicts the application of a wire strap 44 around a material baled through opening 20, according to one embodiment of the invention. In a further embodiment, the wire strap 44 is applied using the wire tying system 14 by travelling along the common track perimeter 18 in a counterclockwise direction.

Figure 4A:
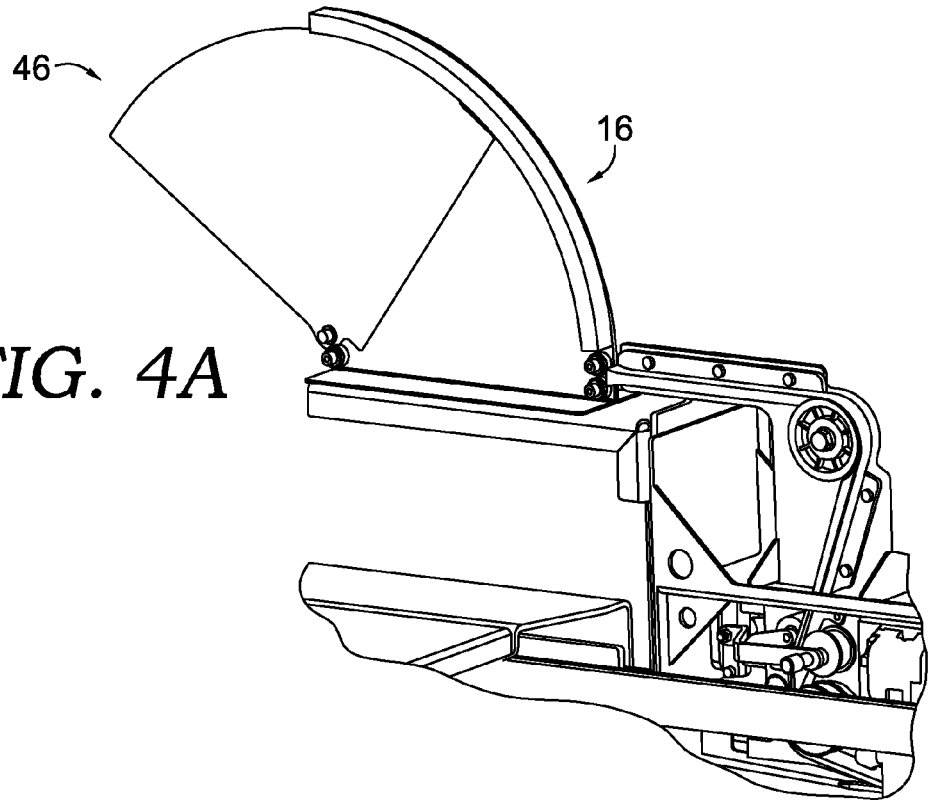
FIG. 4A is an enlarged, perspective view of the plastic tying system of FIG. 1, in accordance with an embodiment of the invention.
Figure 4B:
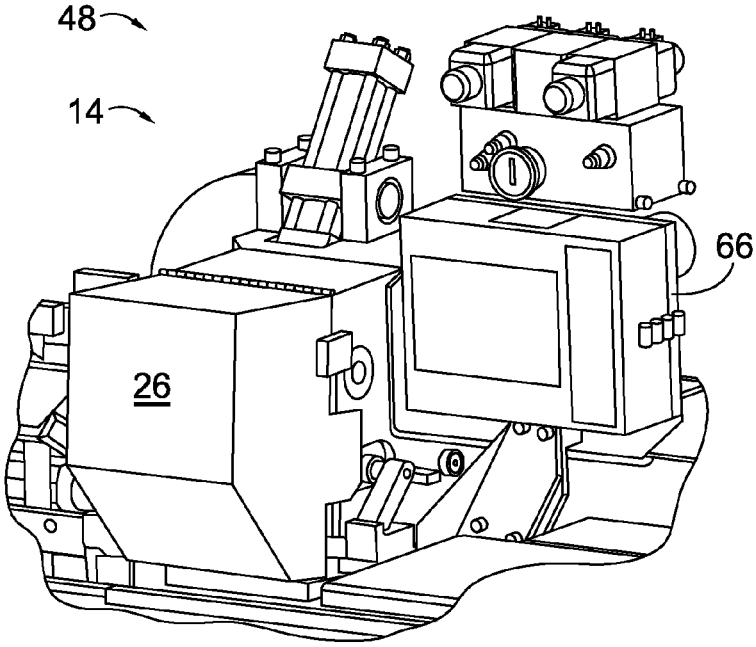
FIG. 4B is an enlarged, perspective view of the wire tying system of FIG. 1, in accordance with an embodiment of the invention.

Turning next to FIG. 4A, an enlarged, perspective view 46 of the plastic tying system 16 is depicted according to an embodiment of the invention. In embodiments, the plastic tying system 16 utilizes a thermal welding head during sealing of a wire strap around a baled material. In further embodiments, based on application of a wire strap around a perimeter of a baled material, the applied material is secured using reverse tensioning. With reference to FIG. 4B, an enlarged, perspective view 48 of the wire tying system 14 is shown in accordance with an embodiment of the invention. Embodiments of the wire tying system 14 include a knotter assembly 26, which may be controlled by the control system 66.

Figure 5:
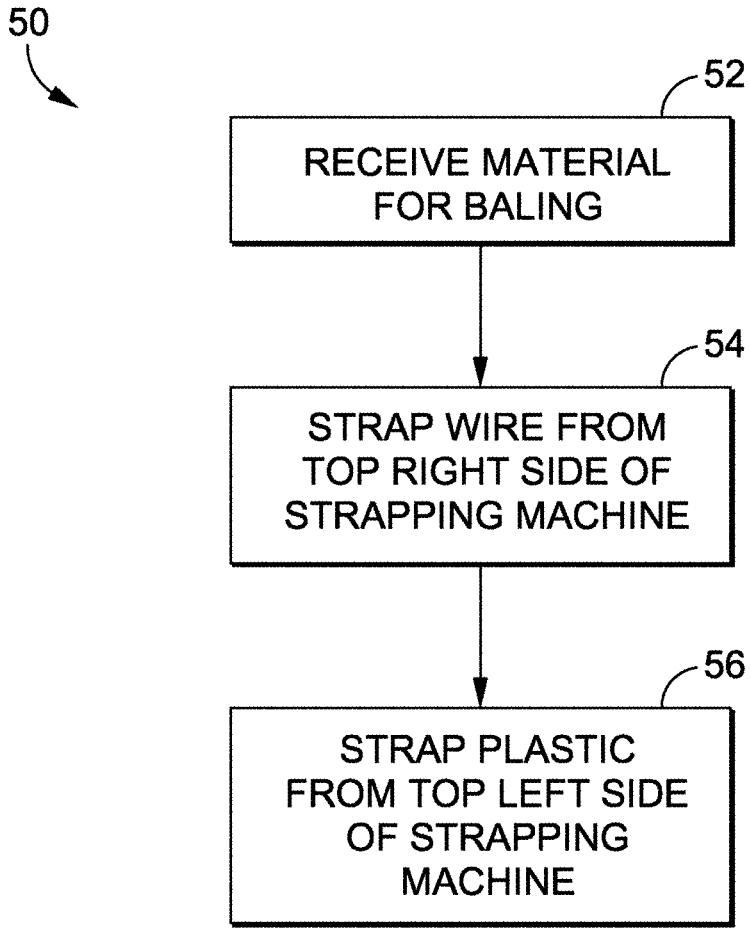
FIG. 5 is a flow diagram of a method of tying a plastic strap and a wire strap using a common strapping machine, in accordance with an embodiment of the invention.

With reference to the flow diagram of FIG. 5, an exemplary method 50 of tying a plastic strap and a wire strap using a common strapping machine is provided. At block 52, a material is received for baling, such as a recycled and/or waste material. At block 54, wire is strapped from a top right side of the strapping machine. In embodiments, based on strapping the wire from a top right side of the strapping machine, the wire continues through the common track perimeter of the strapping machine in a counterclockwise direction. At block 56, a plastic strap is applied from a top left side of the strapping machine. Accordingly, the plastic strap continues through the common track perimeter of the strapping machine in a clockwise direction, according to embodiments of the invention.

Figure 6:
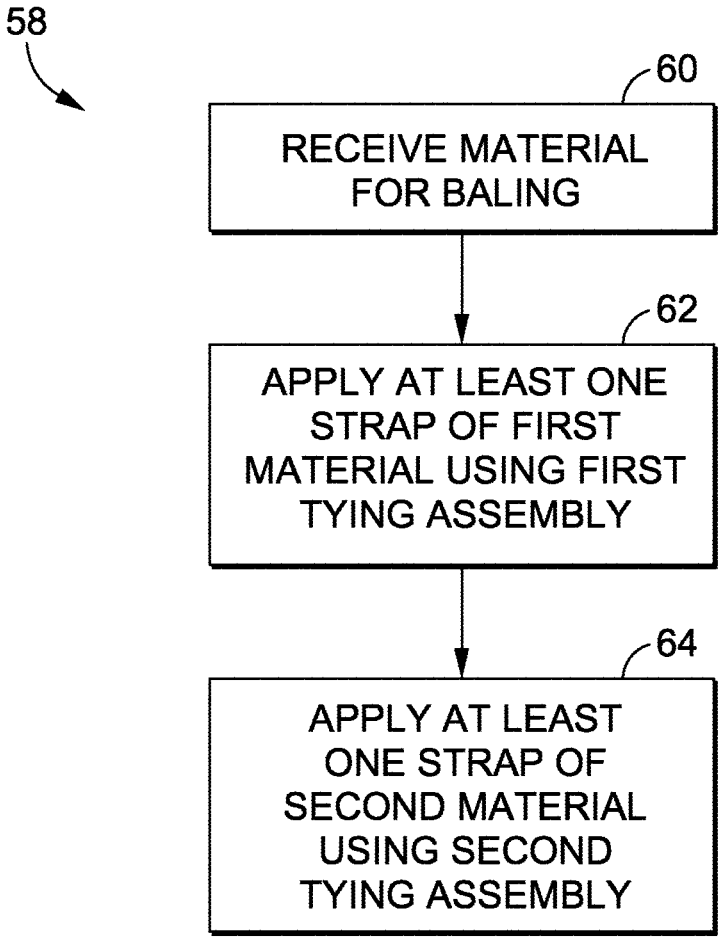
FIG. 6 is a flow diagram of a method of applying a strap of a first material and a strap of a second material using a common strapping machine, in accordance with an embodiment of the invention.

Referring finally to the flow diagram of FIG. 6, an exemplary method 58 of applying a strap of a first material and a strap of a second material using a common strapping machine is described in accordance with an embodiment of the invention. At block 60, a material for baling is received, such as a recycled and/or waste material. At block 62, at least one strap of a first material is applied to the bale using a first tying assembly. In embodiments, the first material is applied to the bale in a first direction around the common track perimeter. At block 64, at least one strap of a second material is applied to the bale using a second tying assembly. In embodiments, the second material is applied to the bale in a second direction around the common track perimeter. In embodiments, the second direction is opposite the first direction, and the second material and/or tying medium is different than the first material and/or tying medium.

As such, when using a common strapping machine for tying a first strap of a first material and a second strap of a second material, in some embodiments of the invention, a particular order of application of multiple types of tying media may be executed. As such, a "recipe" for order of application of different types of straps, such as wire straps and plastic straps, may be provided and utilized by a single, common strapping machine. For example, in one embodiment, a recipe for strapping may include a series of commands for applying 1) a wire strap to a first end of a bale, 2) a plastic strap to the middle of the bale, and 3) an additional wire strap at the second end of the bale. Accordingly, in one embodiment, the baled material may be secured by a wire strap at either end of the baled material, with any combination of wire and/or plastic straps on a middle portion of the bale. In further embodiments, beginning, middle, and end portions of a bale for tying using the strapping machine may be identified by the strapping machine control system, and tied accordingly. As such, different characteristics of different portions of a baled material (i.e., along the y axis of the strapping machine) may require a different tying mechanism and/or strapping medium. In embodiments, the common strapping machine dynamically adjusts to apply different tying straps to different portions of a bale, such as applying multiple different plastic straps and wire straps to a single bale.

In one embodiment, the offset positioning of the plastic tying system and wire tying system provides a tying portion of the strapping machine that is configured to alternate between one type of tying medium and another, without adjusting and/or removing a portion of the strapping mechanism. In some embodiments, the wire tying system is positioned in front of and higher than the plastic tying system. As such, in some embodiments, the wire tying system is closer to the front side A of the strapping machine, while the plastic tying system is closer to the rear side B of the strapping machine. Additionally, in some embodiments, a portion of the wire tying system is positioned a particular distance apart from the plastic tying system, when oriented along the same x axis.

From the foregoing, it will be seen that this invention is one well adapted to attain all the ends and objects hereinabove set forth together with other advantages, which are obvious and inherent to the structure. It will be understood that certain features and subcombinations are of utility and may be employed without reference to other features and subcombinations. This is contemplated by and is within the scope of the claims. Since many possible embodiments may be made of the invention without departing from the scope thereof, it is to be understood that all matter herein set forth or shown in the accompanying drawings is to be interpreted as illustrative and not in a limiting sense.

The invention claimed is:

1. A combination strapping machine for use on a baler, the strapping machine comprising:

a strapping machine frame having a common track perimeter and a top side;

a plastic tying system coupled to the top side of the strapping machine frame, the plastic tying system having a plastic track, wherein the plastic tying system is configured to apply a plastic strap to a baled material, wherein the plastic tying system is configured to apply the plastic strap to the baled material from a first direction relative to the common track perimeter; and a wire tying system coupled to the top side of the strapping machine frame, the wire tying system having a wire track, wherein the wire tying system is configured to apply a wire strap to the baled material, wherein the wire track is adjacent the plastic track, and wherein the wire tying system is configured to apply the wire strap to the baled material from a second direction relative to the common track perimeter, the second direction being opposite the first direction.

2. The strapping machine of claim 1, wherein the plastic tying system comprises a plurality of bloom plates that surround the common track perimeter.

3. The strapping machine of claim 1, wherein the first direction is clockwise.

4. The strapping machine of claim 1, wherein the second direction is counterclockwise.

5. A combination strapping machine for dynamic strapping of a first tying medium and a second tying medium on a baler, the strapping machine comprising:

a strapping machine frame having a common track perimeter;

a first tying system for the first tying medium, the first tying system coupled to a first portion of the strapping machine; and a second tying system for the second tying medium, the second tying system coupled to a second portion of the strapping machine, wherein the first tying system and the second tying system are configured to alternate applying a strap to a baled material secured by the combination strapping machine, wherein the first tying system is configured to apply the first tying medium to the baled material from a first direction relative to the common track perimeter, and wherein the second tying system is configured to apply the second tying medium to the baled material from a second direction relative to the common track perimeter, said second direction opposite the first direction.

6. The combination strapping machine of claim 5, wherein the first portion of the strapping machine is adjacent the second portion of the strapping machine on a first side of the strapping machine frame.

7. The combination strapping machine of claim 5, wherein the common track perimeter comprises a first track for the first tying medium and a second track for the second tying medium.

8. The combination strapping machine of claim 5, wherein the first tying system is a plastic tying system positioned at a rear side of the combination strapping machine.

9. The combination strapping machine of claim 5, wherein the second tying system is a wire tying system positioned at a front side of the combination strapping machine.

10. The combination strapping machine of claim 5, wherein alternately applying a strap to a baled material secured by the combination strapping machine comprises applying at least one strap of the first tying medium and at least one strap of the second tying medium to the bale.

11. The combination strapping machine of claim 5, further comprising an integrated controller for controlling the first tying system and the second tying system.

12. The combination strapping machine of claim 5, wherein the integrated controller is configured to alternate tying the baled material with multiple straps of the first tying medium and multiple straps of the second tying medium according to a particular order for applying each strap of the first tying material and each strap of the second tying material.

13. A method for strapping a baled material, the method comprising:

receiving, by a strapping machine, a material for baling;

applying at least one strap of a first tying medium using a first tying assembly coupled to the strapping machine;

applying at least one strap of a second tying medium using a second tying assembly coupled to the strapping machine; and wherein the at least one strap of the first tying medium is applied to the baled material in a clockwise direction relative to a common track perimeter of the strapping machine, and further wherein the at least one strap of the second tying medium is applied to the baled material in a counterclockwise direction relative to a common track perimeter of the strapping machine.

14. The method of claim 13, wherein applying at least one strap of a first tying medium comprises applying at least one strap of plastic tying medium.

15. The method of claim 13, wherein applying at least one strap of a second tying medium comprises applying at least one strap of wire tying medium.

* * * * *